United States Patent [19]

Pare

[11] Patent Number: 5,027,613

[45] Date of Patent: Jul. 2, 1991

[54] FLOATING ICE RINK

[76] Inventor: Robert L. Pare, 27 Chiswick Rd., Edgewood, R.I. 02905

[21] Appl. No.: 519,124

[22] Filed: May 4, 1990

[51] Int. Cl.[5] ..... A63C 19/10

[52] U.S. Cl. ..... 62/235; 114/264

[58] Field of Search ..... 62/235; 272/3; 273/1 B; 114/263, 264, 266

[56] References Cited

U.S. PATENT DOCUMENTS

| | | | |
|---|---|---|---|
| 1,918,437 | 7/1933 | Torrance | 62/235 |
| 3,910,059 | 10/1975 | MacCracker | 62/235 X |
| 4,275,679 | 6/1981 | Finsterwalder | 114/264 |
| 4,418,634 | 12/1983 | Gerbus | 114/264 X |
| 4,602,587 | 7/1986 | Lyons | 114/264 |
| 4,867,093 | 9/1989 | sullivan | 114/263 X |

*Primary Examiner*—William E. Tapolcai

*Attorney, Agent, or Firm*—Thomas J. Greer, Jr.

[57] ABSTRACT

An ice rink formed from a shallow container having flotation elements on its bottom. The container is filled with water to such an extent that when frozen, the resultant ice layer will be suitable for ice skating. The bottom of the container may be provided with a refrigerant coil to freeze the water in the container. The specific gravity of the rink is less than unity to permit is use in a swimming pool.

10 Claims, 6 Drawing Sheets

FIG. 5
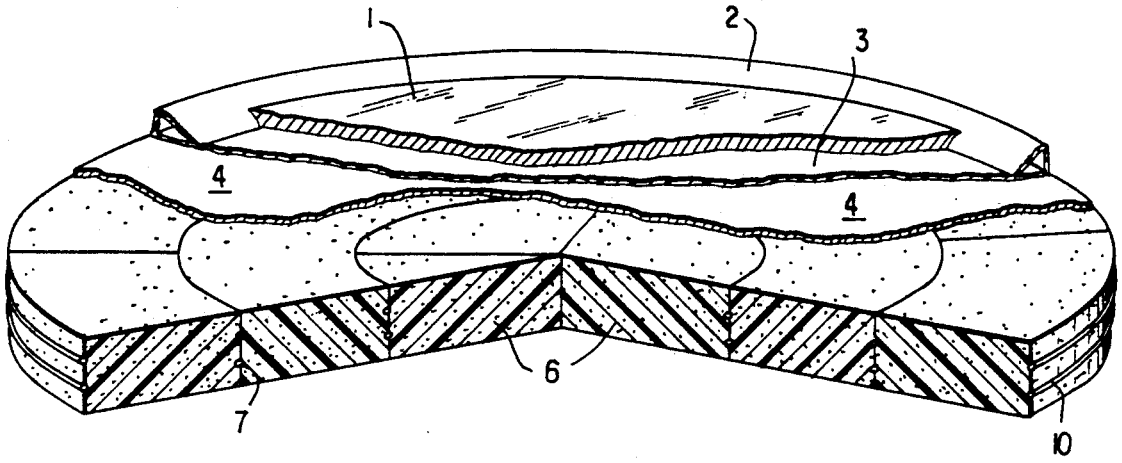
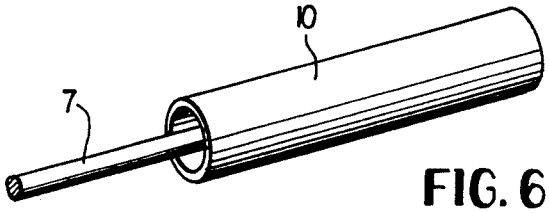
FIG. 6
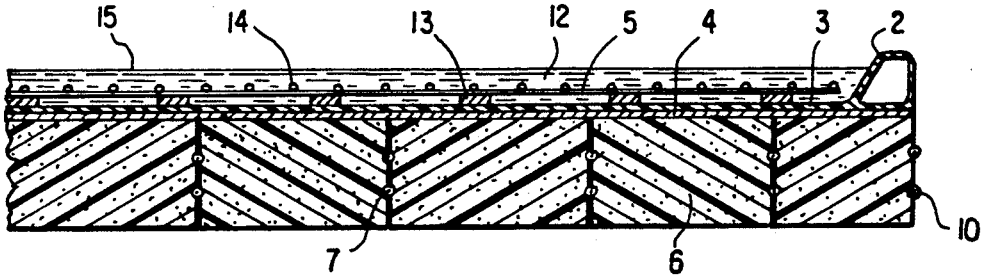
FIG. 7

FIG. 10
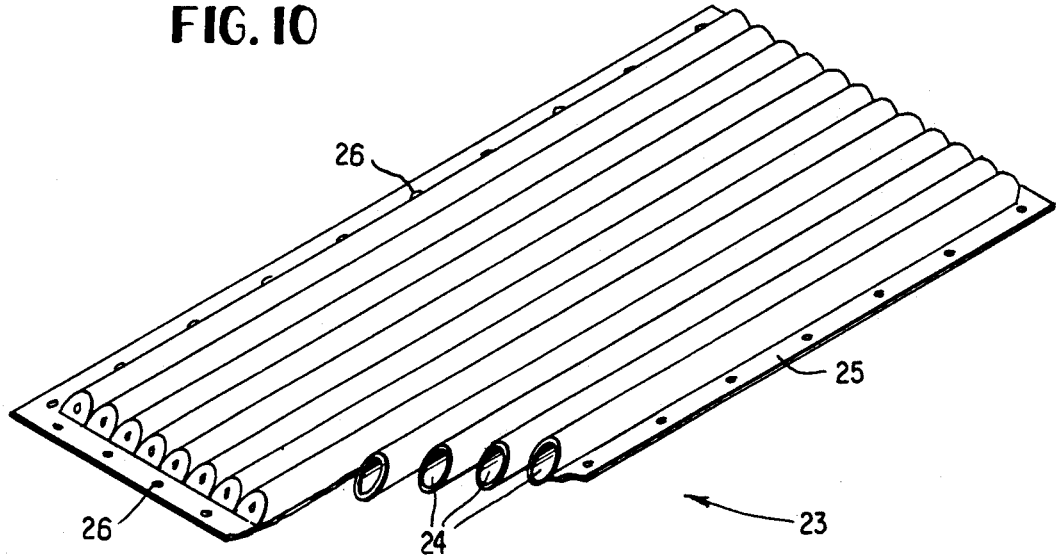
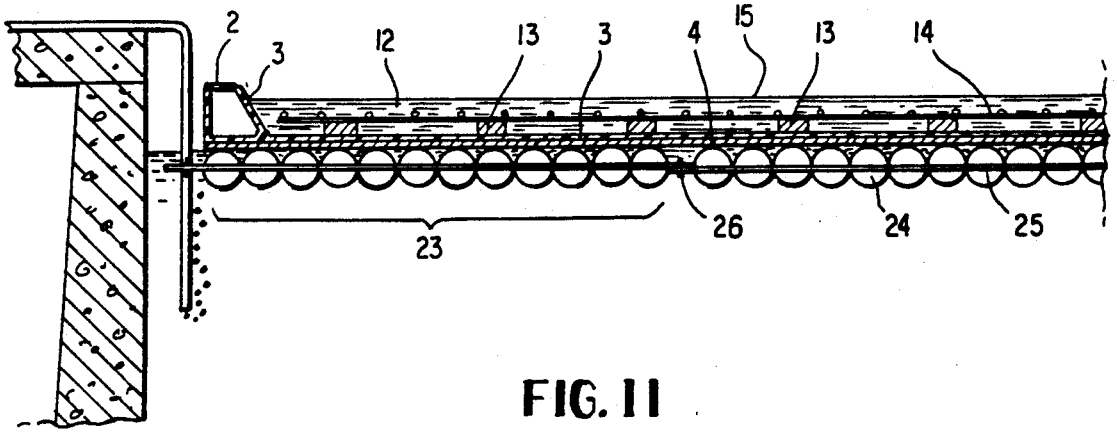
FIG. 11

FLOATING ICE RINK

BACKGROUND OF THE INVENTION

This invention relates to a safe ice rink for use in areas of water adjacent to shore in natural bodies of water or in fabricated aquatic bodies, such as reflecting or swimming pools. The invention consists of a platform which floats on the surface of such body of water, the platform supporting a separate shallow water containment structure which is filled with water. The water in the platform containment structure can be frozen either by natural (low ambient atmospheric temperatures) or by artificial means (refrigeration coils). The floating platform can include multiple units seasonally assembled and disassembled and stored.

SUMMARY OF THE INVENTION

According to the practice of this invention, swimming pools of hotels, marinas, health clubs and the like, as well as private homes can be converted, during the winter season, to safe ice skating rinks or for other winter sports such as curling. This is accomplished by use of a floating platform which supports a layer of ice. The ice may be reinforced with metal mesh to provide additional safety by increasing the tensile strength of the ice layer and further to enhance freezing of the water. It is generally the practice to maintain fabricated (home, motel, etc.) swimming pools filled with water in the winter season, to thereby provide lateral support to the pool walls which would otherwise be cracked due to lateral earth pressure and/or freezing. It is also the practice to cover such pools with sheets of polyethylene or similar sheet material to prevent leaves and dirt from entering the pools in the winter season. These pool covers also help prevent small children and house pets from injury due to falling in the pools.

Certain embodiments of this invention function not only for the use of the ice for winter sports, but also provide a cover to keep out dirt and support the weight of adults and large house pets and provide a barrier to accidental immersion.

The following elements in combination define the invention. (1) A pool or other aquatic body in which the floating skating rink floats. (2) Floats, typically made of styrofoam or similar lightweight, water tight materials, pneumatic tubes, spheres or buoyant bodies such as rigid or semirigid pontoons. (3) A platform consisting of either the top surface of the float elements or a material such as plywood, fiberglass, semi or rigid plastic supported by the float material. (4) A containment system for the water to be frozen, consisting of a peripheral curb and a water tight base or water tight blanket or sheet such as the polyethylene sheets typically used as linings in pools or as boat covers. (5) A system for containing the float elements or of fastening prefabricated float units together to provide uniform support to the platform underlying the ice. This system may consist of mechanical means such as bolting together the frames of adjacent float units; encirclement with rope, wire rope or cable tensioned to hold all units in position; floatation blocks penetrated with horizontal lateral and transverse holes through which tensioning strands of rope, wire tope, cable or rods are placed and tensioned against exterior frame units. Other methods such as a horizontal grillage may be employed to secure and hold the floatation units in the desired position. The above five elements are essential to this invention. The second, third and fourth elements may be combined into a single unit.

Additionally, the following elements may optionally be used in the ice rink: (1) Ice making equipment such as is used for indoor arenas or for portable rinks such as is used with traveling ice shows. (2) Metal mats made of crossed wires or rods; in effect as safety net which has the dual purpose of strengthening the ice and preventing cracks, and also increases the rate of freezing the water on the platform, turning it into ice in less time and more efficiently. (3) Stiffening trusses or frames for large installations or where the skating rink is to be located over moving or tidal water. (4) A guide for positioning the ice rink a few inches from pool walls, or an anchoring system for when the ice rink is to be located over moving or tidal water. (5) An air bubbling system to prevent the formation of ice between the pool walls and the floats is desirable in climatic areas where natural freezing of ponded water frequently exceeds three inches. (6) A ramp or stair is provided when the floating ice skating rink is located over tidal or flowing water. (7) Guard rails on the perimeter of all ice rinks that do not fully occupy a pool to within four inches of all adjacent walls and for all pools over open water.

BRIEF DESCRIPTION OF THE DRAWINGS

FIG. 5 is a partially broken perspective view of a section of an ice rink for a circular, elliptical or other convexly curved rink.

FIG. 6 is a partial perspective view of a tension cable and surrounding tube of FIG. 5.

FIG. 7 is a cross sectional view of a circular ice rink similar to that of FIG. 5.

FIG. 10 is a partially broken perspective view of a tubular blanket pneumatic flotation unit.

FIG. 11 is a cross-sectional view of an ice rink using blanket type pneumatic tubular elements of FIG. 10 for floatation.

DETAILED DESCRIPTION OF THE INVENTION

Figure 1:
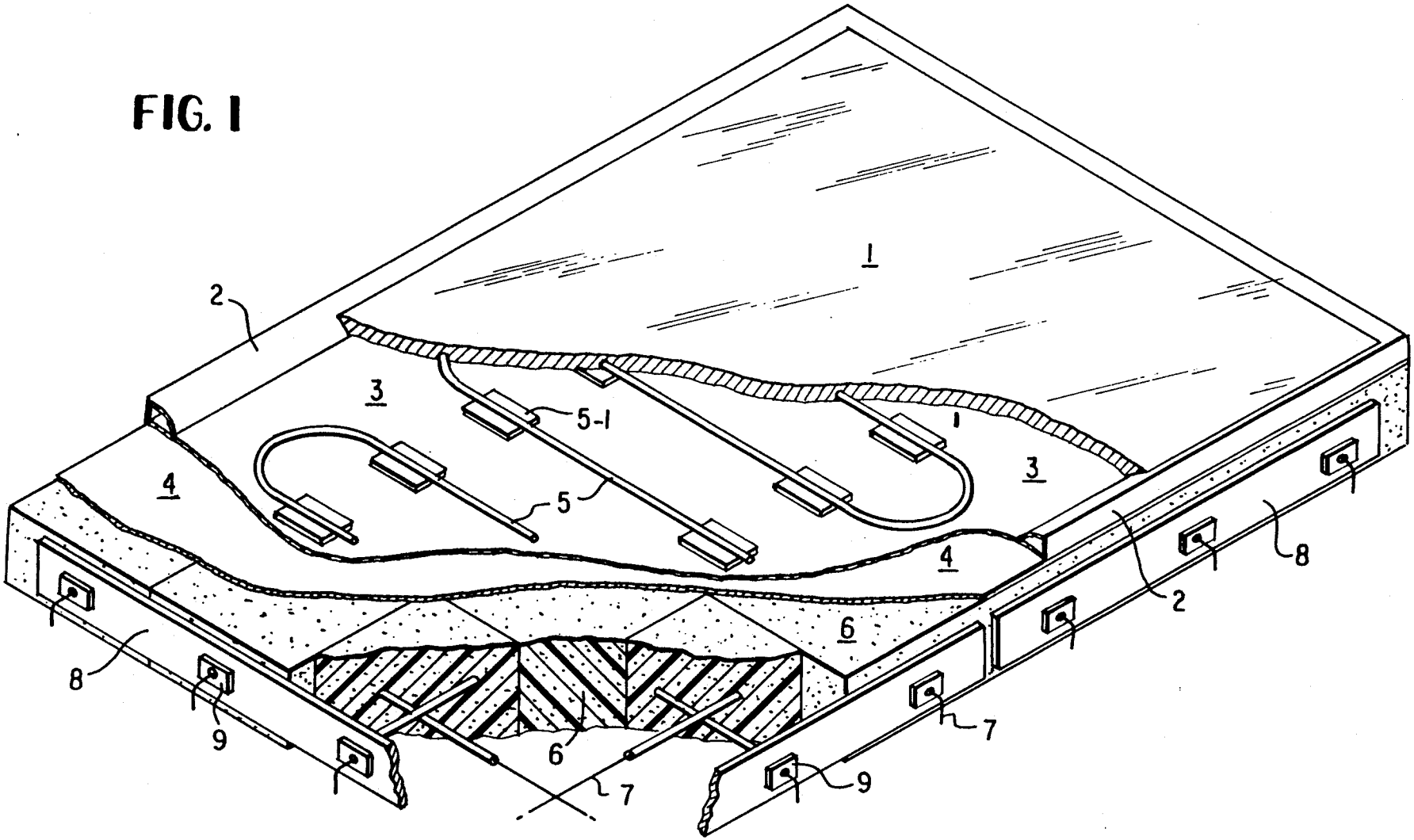
FIG. 1 is a partially broken perspective view of a rectangular embodiment of the floating platform ice skating rink of this invention.

Referring to the drawings, the ice rink of this invention is shown. A layer of ice 1 is bordered by a peripheral water/ice retaining curb 2 whose height, measured vertically from the bottom of the ice, is greater than the depth of the ice layer. A water impervious sheet 3 of polyethylene or rubber impregnated woven material rests on the top surface of a rigid sheet platform 4, typically of plywood, with ice layer 1 resting on sheet 3. The platform and curb define a shallow container. A continuous serpentine refrigeration tube 5, mounted on wooden pad supports 13 on sheet 3 becomes embedded in the ice after freezing of the water. A plurality of flotation blocks 6 are pierced by a plurality of orthogonally running tension cables or tendons 7, the tendons passing through holes or tubes 10 in the blocks. Each block receives two or more tendons. Exterior frame panels 8, fashioned typically of wood, surround the rink and carry tendon anchorages 9 of known construction. A layer of wire reinforcement 14 is positioned on top of refrigerant tube 5 (see FIG. 7) and functions to both speed up freezing and strengthen the ice.

Figure 2:
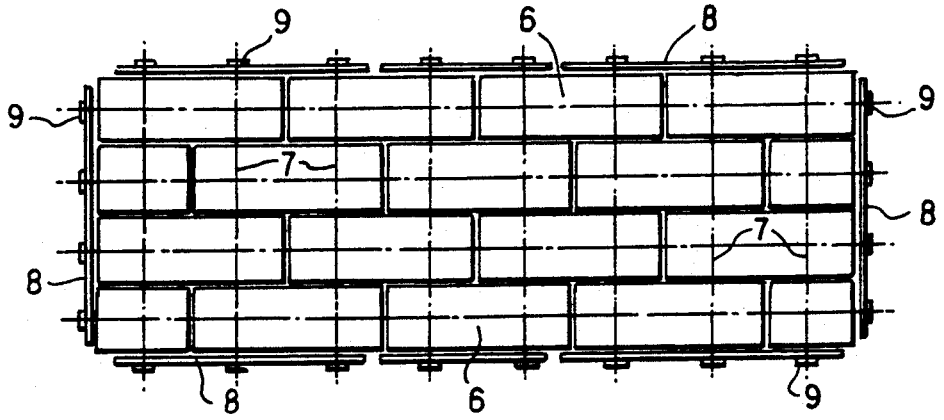
FIG. 2 is a plan view of the rink of FIG. 1.

FIG. 2 illustrates the relation between floatation blocks 6, tendons or cables 7, panels 8 and tendon anchorages 9. The flotation blocks are illustrated as rectangular, although they may be square in plan view.

Figure 3:
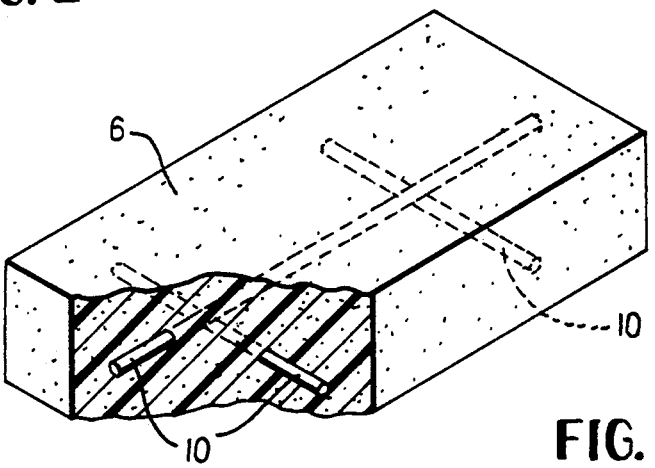
FIG. 3 is a partially broken perspective view of a typical floatation block which forms a part of the rink and through which holes or tubes have been placed to receive tensioning strands.

FIG. 3 illustrates a typical block 6 having tubes 10 passing therethrough. Tubes 10 of any block are aligned with corresponding holes in the other blocks to form continuous passages for receiving respective tendons 7.

Figure 4:
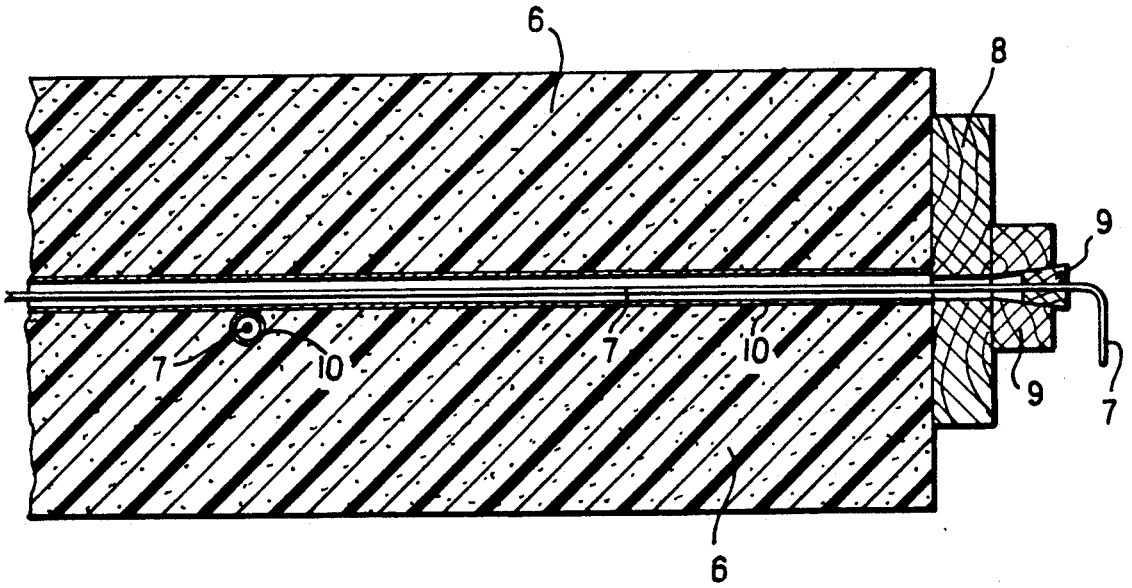
FIG. 4 is a cross sectional view of a typical floatation block showing details of the tensioning system and end frame and anchorage of the tensioning strands.

FIG. 4 illustrates a cross-section of a typical block near the periphery of the rink, showing exterior frame panels 8 and tendon attachment members 9. The latter are defined, conventionally, by an apertured block of wood with a split frusto conical wedge member for frictionally engaging the periphery of a typical flexible tendon or cable 7. It will be understood that the cable anchorage 9 may assume any of a number of known forms and that tendons 7 may be flexible, as cable, or rigid, as with metal bars.

Referring now to FIGS. 5 and 6 of the drawings, a modified form of the ice rink is illustrated. Flotation elements 6 are arcuate in form, with the radially innermost elements pie shaped. The outer periphery of each radially distinct group of flotation elements is provided with tension cables or tendons 7 running within associated tubes 10, as shown FIG. 6.

Figure 8:
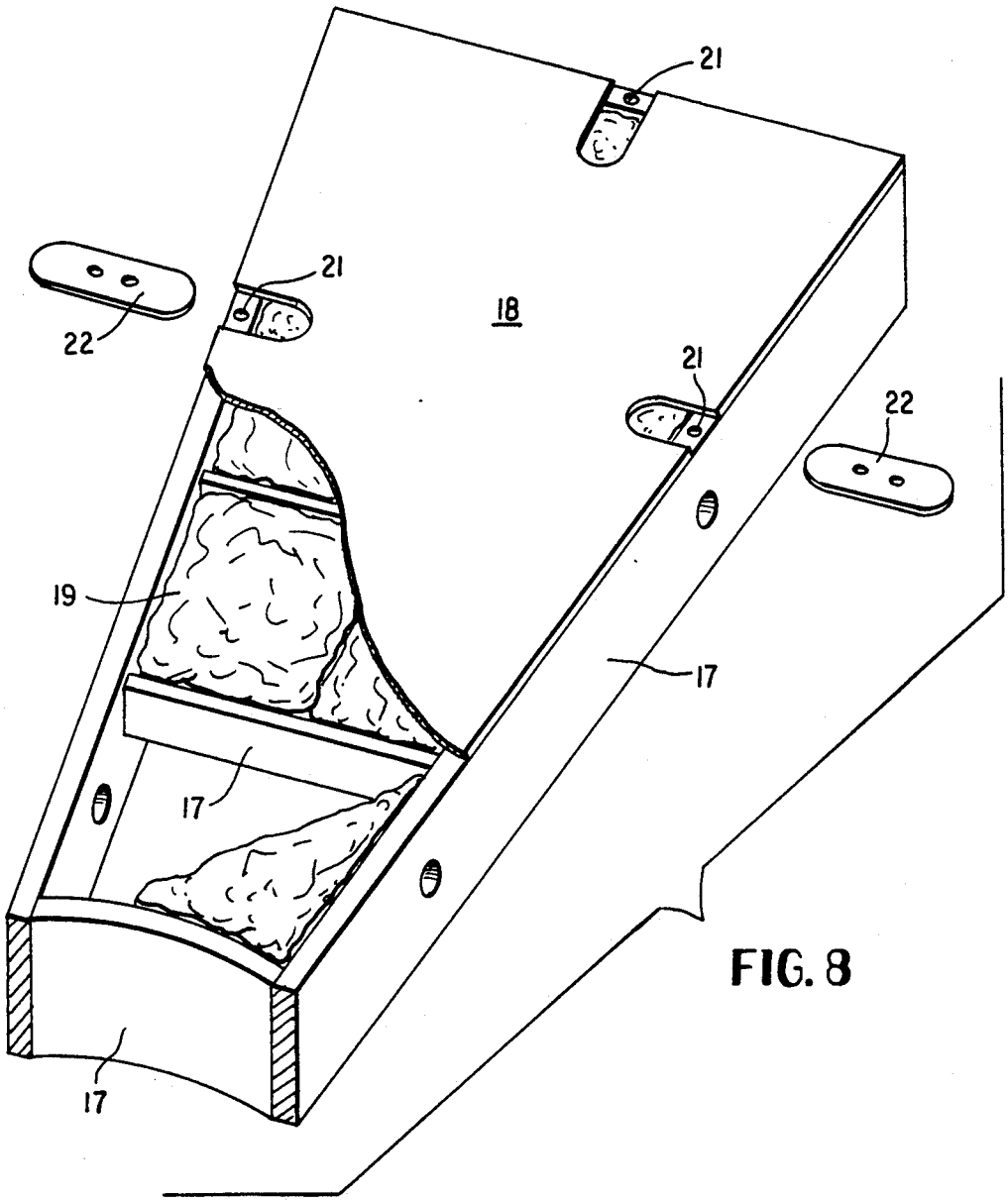
FIG. 8 is a partially broken perspective view of a floatation unit.
Figure 9:
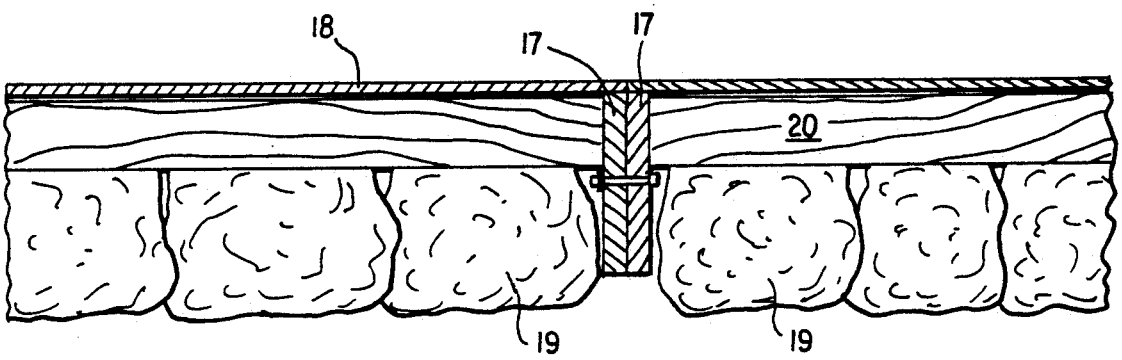
FIG. 9 is a partial sectional view taken along two coupled units of FIG. 8.

Turning now to FIG. 7, a partial transverse cross-section of the ice rink shown at FIG. 5 is illustrated, without exterior frame panels 8 and tension with cables 7. Curb 2 may be of wood or plastic or a tube filled with sand for example, but should not be a pneumatic tube or a water filled tube subject to puncture by ice skates. Further, reinforcing wire grid 14 and refrigerant tube 5 are usually both made of aluminum to eliminate electrolysis. If a particular environment for the ice rink does not require artificial refrigeration, then the refrigerant tubes 5 may be omitted and reinforcing grid 14 may be of steel rods, glass fiber or other material with a high modulus of elasticity and will not become brittle at temperatures down to −20° F. (−28° C). The numeral 15 denotes the maximum level of water which will form ice layer 1. Normally, a minimum level of 1 inch over the reinforcing wire grid 14 is required, but the thickness may be greater and almost up to the top of curb 2 as indicated. Typically, the thickness of ice layer 1 will be from 3 to 5 inches. Referring to FIG. 8, another embodiment of a float for the ice rink is illustrated. The floats are fashioned from a plurality of sections 16. Each section is generally rectangular shape but can be truncated triangular as shown or of any shape and includes wooden frame members 17 which form the sides and cross frames and which divides the interior of each section into cells. Each cell contains flotation material 19 which may assume the form of blocks of styrofoam, pneumatic balls in plastic bags or other flotation elements. The top of each section 16 is closed by a rigid panel 18. The sections are provided with openings 21 which accommodate elongated, flat and apertured coupling brackets 22. FIG. 9 illustrates bolts 20 passing through aligned openings in the sides of adjacent flotation elements 16. Brackets 22 also couple these elements together.

FIG. 10 illustrates a flotation unit 23 similar to an air mattress used by campers and body surfers. This element consists of a series of longitudinal tubes 24 which can be individually inflated and deflated and are encased in a cover of fabric 25. The periphery of the unit includes a plurality of eyelets 26 for fasteners securing abutting flotation units together.

FIG. 11, an ice rink as shown with flotation units 23 of FIG. 10. Several flotation units are secured together by means of fasteners in eyelets 26. Overlying flotation units 23 is a platform of plywood 4 upon which is set a curb 2, the plywood platform is covered with a water retention sheet 3 of polyethylene. Wooden blocks 13 lie on top of sheet 4 and wire grid 14 is placed on top of the wooden blocks. Water in a typical concrete swimming pool receives the ice rink. A bubbler tube insures an ice free pool periphery. The ice rink of FIG. 11 may or may not require artificial refrigeration, such as coil 5 of FIG. 1. One advantage of the embodiment of FIG. 11 is that without rigid flotation elements, storage requirements of the skating rink during summer months will be appreciably less.

Figure 12:
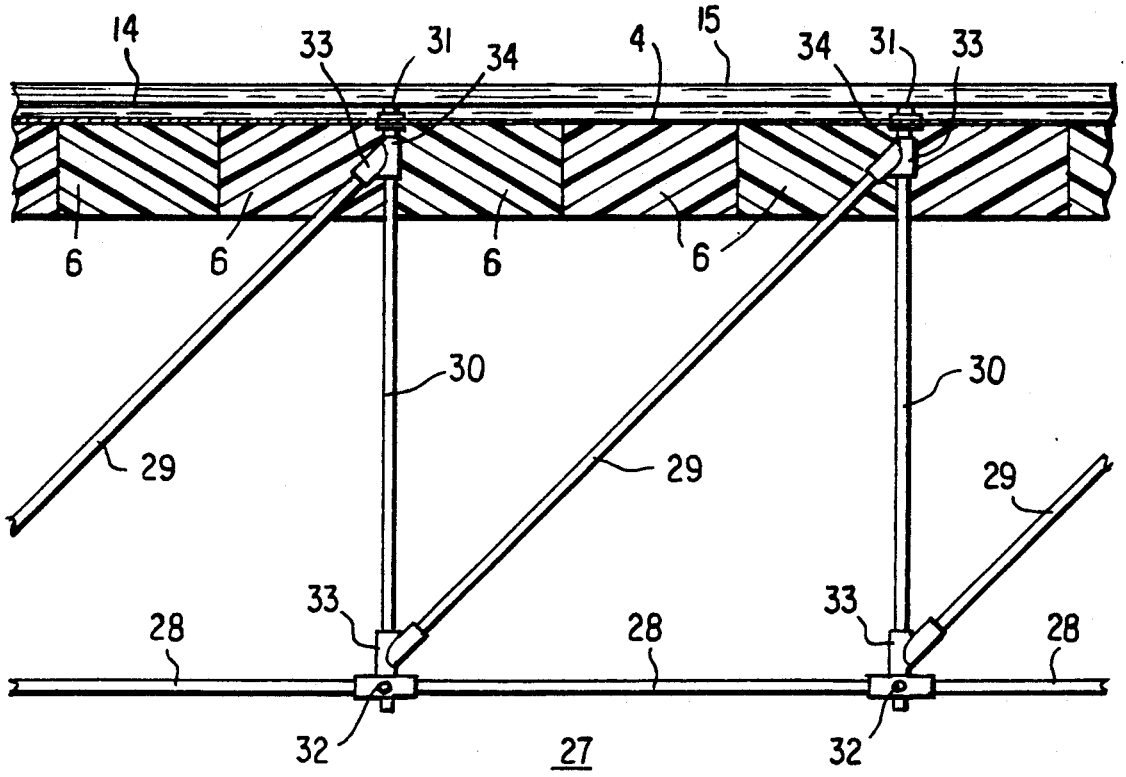
FIG. 12 is a side elevational view of a truss that can be incorporated with the skating rink of this invention to provide greater support and stiffness.

FIG. 12 illustrates frame or lattice 27 formed by coupled pipe trusses. Again, a layer of ice 1 has wire grid elements 14 embedded therein. A plywood sheet 4 is provided at regular intervals with apertures, with one end of a typical vertical pipe 30 extending through a respective aperture. Washers 34 are positioned on the top underside of sheet 4 and function to seal the annular space around pipes 30 as they pass through the plywood. Flotation blocks 6 are located beneath the plywood for flotation of the entire structure. Diagonal pipes 29 are secured to the vertically extending pipes by coupling elements 33, with sleeve coupling members 32 securing horizontally running truss members 28 together. The weight of the truss, the ice and the other elements will determine the size and character of flotation blocks 6. The assembly illustrated in FIG. 12 is shown without refrigeration elements, although it is obvious that they may be employed, as with the embodiment of FIG. 1. The entire structure is adapted to float.

I claim:

1. A floating ice rink, said rink being in the form of a shallow container having an impervious flexible sheet supported on a rigid sheet, a smooth layer of ice on the flexible sheet, said rink having an upstanding peripheral curb therearound whose uppermost top rim edge is above the upper surface of said layer of ice, said rigid sheet resting on and supported by modular flotation units, said modular flotation units being releasably held together to permit assembly and disassembly thereof for storage and transport.

2. THe ice rink of claim 1 including refrigeration coils on top of said flexible sheet for cooling water to form ice, said refrigeration coils embedded in the layer of ice.

3. The ice rink of claim 2 wherein said modular flotation units are generally rectangular blocks and are provided with apertures extending therethrough, the apertures receiving cables under tension to maintain the flotation units together, the ends of the tensioning cables anchored to frame panels at the peripheral edges of the rink.

4. The ice rink of claim 2 wherein the modular flotation units are arcuate in form and are arranged in a plurality of radially spaced groups, the radially outermost portion of each group having at least one tensioned cable therearound, each radially spaced group of flotation units being circumferentially tensioned, the radially outermost portion of each radially spaced group being curved.

5. The ice rink of claim 2 wherein each of the modular flotation units is composed of wood strips fastened together to form an open frame having a depth equal to the width of the wood strips, said rigid sheet being in sections with one section thereof fastened to one side of each said frame, the other side of each frame being open and receiving styrofoam flotation elements or plastic hollow spheres encased in plastic bags as flotation elements, the modular flotation units detachably held together by bolts passing through side by side wood strips of individual adjacent wood strips of next adjacent modular flotation units, and also held together by brackets extending from the edge of any modular flotation unit to the edge of any next adjacent modular flotation unit.

6. The ice rink of claim 5 wherein each modular flotation unit is wedge shaped in form.

7. The ice rink of claim 1 including means within said layer of ice for reinforcing the ice.

8. The ice rink of claim 2 wherein each modular flotation/unit is defined by an air mattress encased in a fabric cover, the periphery of each fabric cover having a plurality of eyelets, the eyelets of respective fabric covers secured together by fasteners, each air mattress defined by a series of elongated, parallel tubes joined together along their sides to define a planar array of tubes.

9. The ice rink of claim 1 including vertical and diagonal truss members, upper ends of the vertical truss members extending through apertures in said rigid sheet and through said modular flotation elements, seal elements around the upper ends of the vertical truss members to seal the annular spaces between said rigid sheet and the upper ends of the vertical truss members where said vertical truss members pass through the rigid sheet, the diagonal truss members coupled to the vertical truss members by coupling elements.

10. The ice rink of claim 9 including refrigeration coils on top of said flexible sheet for cooling water to form ice, said refrigeration cells embedded in the layer of ice, and further including means within said layer of ice for reinforcing the ice.

* * * * *